US011666146B2

(12) United States Patent
Sponga et al.

(10) Patent No.: US 11,666,146 B2
(45) Date of Patent: Jun. 6, 2023

(54) ANTI-RELEASE SYSTEM FOR A SLIDING DRAWER

(71) Applicant: BORTOLUZZI SISTEMI S.P.A., Belluno (IT)

(72) Inventors: Bruno Sponga, Belluno (IT); Marco Pianca, Belluno (IT)

(73) Assignee: BORTOLUZZI SISTEMI S.P.A., Belluno (IT)

( * ) Notice: Subject to any disclaimer, the term of this patent is extended or adjusted under 35 U.S.C. 154(b) by 0 days.

(21) Appl. No.: 17/415,042

(22) PCT Filed: Dec. 15, 2019

(86) PCT No.: PCT/IB2019/060814
§ 371 (c)(1),
(2) Date: Jun. 17, 2021

(87) PCT Pub. No.: WO2020/128770
PCT Pub. Date: Jun. 25, 2020

(65) Prior Publication Data

US 2022/0061527 A1 Mar. 3, 2022

(30) Foreign Application Priority Data

Dec. 19, 2018 (IT) ..... 102018000020176

(51) Int. Cl.
*A47B 88/407* (2017.01)
*A47B 88/427* (2017.01)

(52) U.S. Cl.
CPC ..... *A47B 88/407* (2017.01); *A47B 88/427* (2017.01); *A47B 2088/4276* (2017.01);
(Continued)

(58) Field of Classification Search
CPC ..... A47B 88/407; A47B 88/427
(Continued)

(56) References Cited

U.S. PATENT DOCUMENTS 3,282,635 A * 11/1966 Himelreich ..... A47B 88/941 312/330.1
4,810,045 A * 3/1989 Lautenschlager .... A47B 88/427 312/334.5

(Continued)

FOREIGN PATENT DOCUMENTS

GB 2449894 A 12/2008

OTHER PUBLICATIONS

International Search Report of PCT/IB2019/060814 dated Apr. 22, 2020.

*Primary Examiner* — James O Hansen
(74) *Attorney, Agent, or Firm* — Mark M. Friedman

(57) ABSTRACT

A sliding drawer or shelf (12) of a piece of furniture, comprising:

a perimeter frame defined by the union of a front segment (14) and three C-connected segments (16, 18);

a telescopic guide (20) for linearly moving the drawer or shelf with respect to the piece of furniture, the guide comprising a part (22) that can be fixed on the piece of furniture, and a part (24) longitudinally translatable with respect to the fixed part, the translatable part comprising an arm (26) which is adapted to support the drawer or shelf and on which there is mounted an adjustment element (80) for the inclination of the drawer or shelf with respect to the fixed part, wherein the front segment comprises a stop element (50) by which a free end of the arm can be engaged, so that the free end of the arm opposes to a lifting of the drawer or shelf by abutting against a part of the stop element.

12 Claims, 2 Drawing Sheets

(52) U.S. Cl.
CPC ..... *A47B 2210/0054* (2013.01); *A47B 2210/0056* (2013.01)

(58) Field of Classification Search
USPC ..... 312/334.4
See application file for complete search history.

(56) References Cited

U.S. PATENT DOCUMENTS

| | | | | | |
|---|---|---|---|---|---|
| 5,375,922 | A * | 12/1994 | Brustle | ..... | A47B 88/427 312/334.4 |
| 6,945,618 | B2 * | 9/2005 | Kim | ..... | A47B 88/427 312/334.4 |
| 7,695,080 | B2 * | 4/2010 | Chen | ..... | A47B 88/427 312/334.4 |
| 8,979,223 | B2 * | 3/2015 | Huang | ..... | A47B 88/427 312/334.4 |
| 2003/0234603 | A1 | 12/2003 | Salice | | |
| 2012/0292465 | A1 * | 11/2012 | Holzer | ..... | B60W 50/0097 248/221.11 |

* cited by examiner

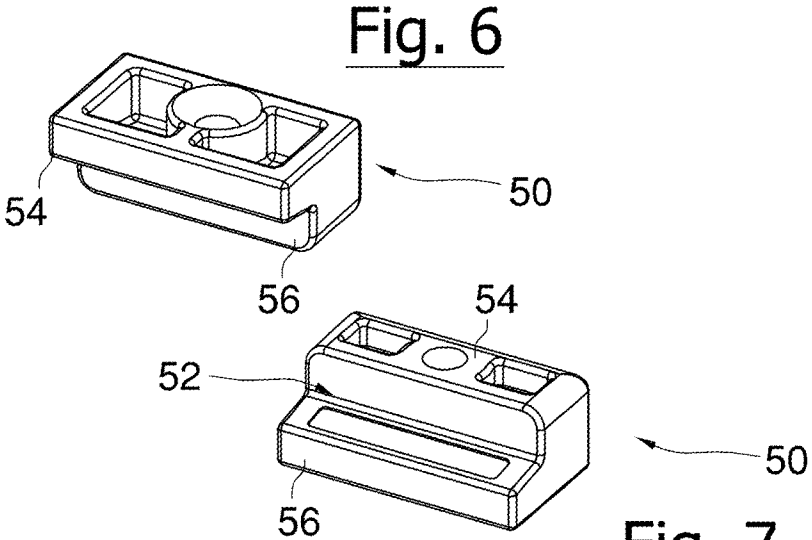
Fig. 6
Fig. 7
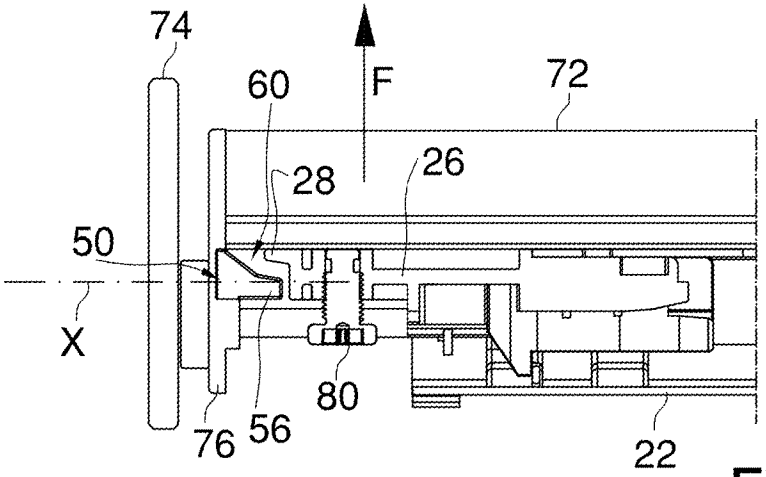
Fig. 5
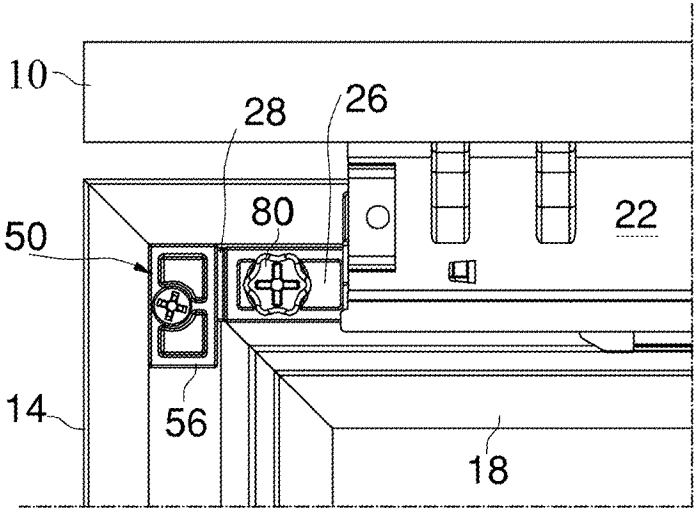
Fig. 3
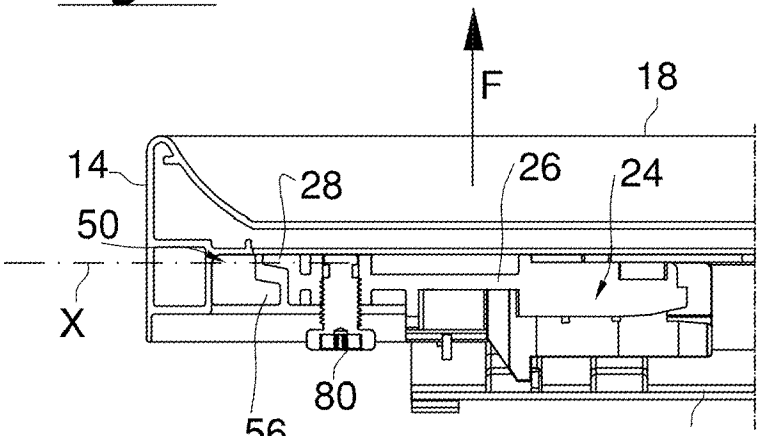
Fig. 4

ANTI-RELEASE SYSTEM FOR A SLIDING DRAWER

The invention relates to an anti-release system for sliding drawers or shelves, or an anti-lifting system for sliding drawers or shelves. In particular, the invention refers to an improved telescopic guide for drawers or shelves, of the type comprising a device for adjusting the position of the drawer with respect to both its seat and the others drawers or shelves.

It is known that furniture or cabinets are furnished with drawers or shelves, which in some models are horizontally sliding and removable. The drawer or shelf can have integral guides, e.g. the classic grooves on the sides, or is mounted on two linear guides fixed to the walls of the furniture.

The guides are often sophisticated devices, which allow a fine adjustment of the position of the drawer, see e.g. EP1621107. Thus the drawer can be moved laterally so as to allow adjustment of its horizontal level and the correct spacing from the other drawers and from the sides of the cabinet.

The drawer or shelf is constrained to the guides to prevent its disengagement in the vertical direction or its accidental detachment. Unfortunately the known constraint means are generally complicated to produce and difficult to use during the installation phase.

Improving this state of the art is the main object of the invention, which is defined in the appended claims, wherein the dependent ones define advantageous variants.

Another object is to provide a guide of the above mentioned type in which the means of vertical constraint for the drawer or shelf are simple to produce and easy to use during assembly.

Another object is to provide a guide of the above mentioned type wherein the size of the constraint means is limited.

Another object is to provide a guide of the above mentioned type which integrates vertical restraint means against the vertical disengagement of the drawer or shelf from the guides.

Another object is to provide an improved assembly given by a guide of the above mentioned type and an associated drawer or shelf.

Another object is to provide an improved sliding drawer or shelf associated with a guide of the type mentioned above.

A sliding drawer or shelf of a piece of furniture is proposed, comprising:

- a perimeter frame defined by the union of a front segment and three C-connected segments;
- a telescopic guide to linearly move the drawer or shelf with respect to the piece of furniture, the guide comprising
  - a part that can be fixed on the piece of furniture, and
  - a part translatable longitudinally with respect to said fixable part,
- the translatable part comprising an arm which is adapted for supporting the drawer or shelf and on which there is mounted an element for adjustment of the inclination of the drawer or shelf with respect to fixable part,
- wherein the front segment comprises a stop element by which a free end of the arm can be engaged, so that the free end of the arm opposes a lifting of the drawer or shelf by abutting against a part of the stop element.

This solution prevents the drawer or shelf from accidentally lifting.

According to a preferred embodiment, the stop element comprises or forms a cavity in which a free end of the arm can be trapped, so that the free end of the arm opposes a lifting of the drawer or shelf by abutting against a wall of the cavity.

The cavity is advantageously producible in a simple and inexpensive way, and may be e.g. a hole, a recess, or an undercut of the front segment.

Whenever it is desired not to affect the surface of the front segment, for a preferred embodiment the drawer or shelf comprises a component mounted superficially on the front segment to form the cavity. The cavity is created by the same component assembled superficially or by cooperation of the component assembled superficially and parts of the front segment.

In particular, said component comprises a step and is mounted on the front segment so that the cavity is made from a surface of the step and a wall of the front segment.

Preferably, said component is a solid with L-shaped cross section, to determine said step.

According to a preferred, simple and economic embodiment, the free end of the arm comprises a protruding tooth adapted for being inserted into the cavity. To minimize the overall dimensions, the protruding tooth is preferably arranged along a longitudinal axis of the arm.

Preferably the adjustment element comprises an element mounted movably or rotatably on the arm to protrude from the arm and abutting against the drawer or shelf by means of an adjustable-protrusion portion. In particular, if the element is rotatably mounted, it is preferred that it is provided with a thread and is screwed into the arm to protrude from the arm via an adjustable-protrusion portion. Screwing is a simple and precise form of adjustment.

Preferably the front segment and the three C-connected segments are hollow tubular elements, each with ends cut at 45 degrees for fitting with the ends of two other segments. However, other structures are possible.

In particular, the three C-connected segments are e.g. hollow tubular elements, each with ends cut at 45 degrees to fit ends of the other two segments, and the front segment comprises a rigid wall provided with two anchoring members that protrude orthogonally therefrom and are each insertable in a respective cavity of a different segment forming the C.

The advantages of the invention will be even clearer from the following description of a preferred exemplary system, referring to the attached drawing in which FIG. 1 shows a three-dimensional view of a sliding drawer inserted in a piece of furniture;

FIG. 3 shows a plan view of the elements of FIG. 2;

FIG. 4 shows a cross-sectional view according to a vertical plane passing through the X axis of FIG. 1;

FIG. 5 shows a variant of the system;

FIG. 6 shows a three-dimensional view of a component of the system;

FIG. 7 shows a different three-dimensional view of the component of FIG. 6.

In the figures equal numbers indicate equal or conceptually similar parts, and the elements are described as in use. In order not to crowd the figures some numerical references are omitted.

Figure 1:
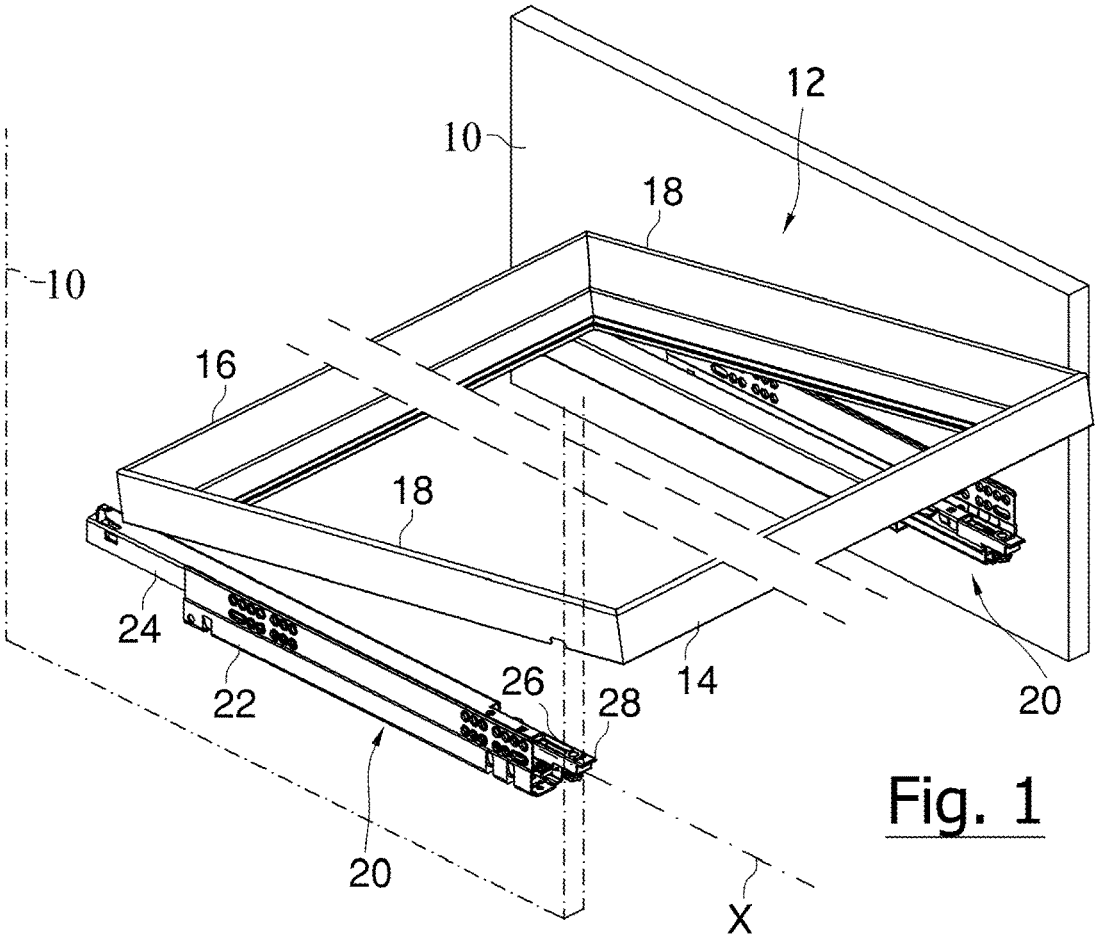

FIG. 1 partially shows the side walls 10 of a piece of furniture or cabinet inside which there is mounted a sliding drawer or shelf 12.

The sliding drawer or shelf 12 comprises a frame having a front segment 14, a bottom segment 16 and two lateral segments 18. The segments 14, 16, 18 are tubular parts with ends cut at 45 degrees to fit to each other, and are assembled to form an overall rectangular or square frame. For simplicity, the bottom of the sliding drawer or shelf 12 is not shown.

The lateral segments 18 are respectively mounted above two linear guides 20 which are specularly identical and fixed to the walls 10.

Each linear telescopic guide 20 comprises two parts 22, 24 which are linearly translatable relatively to each other. The part 22 is fixed and connectable/connected to the wall 10, while the part 24, translatable along a X axis with respect to part 22, can be connected to one of the segments 18. Thus the sliding drawer or shelf 12 can be removed frontally from the furniture item.

Figure 2:
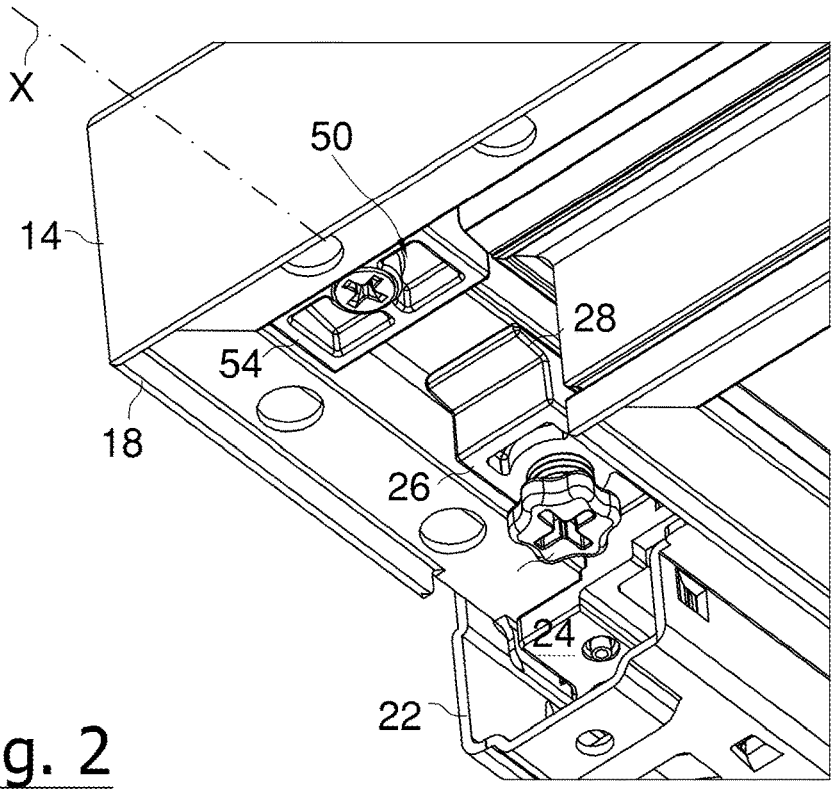
FIG. 2 shows a three-dimensional view from below of a drawer.

With reference to FIGS. 2÷4, one can see the sliding drawer or shelf 12 mounted on the guide 20. The translatable part 24 comprises a horizontal arm 26 on which the sliding drawer or shelf 12 is placed. The arm 26, at the end closest to the front segment 14, ends with a protruding tooth 28, which extends cantilevered from the arm 26 lying on a—in use—horizontal plane.

Preferably the guide 20 comprises an adjustment device for the inclination of the drawer or shelf 12 with respect to the fixed part 24. To make this inclination adjustment device e.g. the end of the arm 26 closest to the front segment 14 is equipped with a screw 80, screwable vertically into the arm 26 so that the tip of the screw 80 protrudes from the arm 26 under the drawer or shelf 12. By screwing more or less the screw 80, the tip of the screw 80 can protrude more or less from the arm 26 and lift more or less the drawer or shelf 12 (or a segment 18). This allows an adjustment of the inclination of the drawer or shelf 12.

Preferably the guide 20 comprises a rear stop element (not shown) to avoid detachment of the drawer or shelf 12.

Inside the front segment 14, on the surface facing the inside of the sliding drawer or shelf 12, there is integrally mounted, e.g. with screws or adhesive, a block 50 (see also FIGS. 6 and 7). The block 50 is a parallelepiped lacking an edge, so it is made as a sort of three-dimensional L. In other words, the block 50 comprises a step 52 defined by the union of two parallelepipeds 56, 54 having different bases and two coplanar sides. The block 50 is mounted on the segment 14 so that the step forms a cavity 60 in the internal wall of the segment 14.

The horizontal arm 26 is preferably movable back and forth with respect to part 24 through an initial adjustment, during assembly, while during ordinary use the horizontal arm 26 remains integral with the part 24. In particular the adjustment of the horizontal arm 26 can be used, during assembly, to tune-up the horizontal position of the drawer or shelf 12 with respect to the walls 10.

Or the horizontal arm 26 is fixed on—and integral with—the part 24.

At the end of the assembly of the sliding drawer or shelf 12 on the guides 30 20, the tooth 28 is inserted into the cavity 60 (see FIG. 4). In this way, during ordinary use, the tooth 28 opposes to a lifting of the parallelepiped 54 when the sliding drawer or shelf 12 (see arrow F) is pushed up. In other words, if one tries to lift the sliding drawer or shelf 12 (see arrow F) the parallelepiped 54 hits the tooth 28 and the sliding drawer or shelf 12 remains locked into horizontal position and does not detach itself from the guide 20.

The tooth 28 may be positioned in the cavity 60 either by translating the arm 26 towards the sliding drawer or shelf 12, if the arm is adjustable, or by eventually fixing the block 50 to the front segment, so as to build the cavity 60 around the tooth 28.

FIG. 5 shows a solution similar to FIG. 4 but applied to a sliding drawer or shelf 70 of different type.

The sliding drawer or shelf 70 comprises a C-shaped frame, made from tubular elements. The C-shaped frame has a bottom segment (no shown) joined to two lateral segments 72. The front segment 74 is mounted on the C to form an overall rectangular or square frame. The assembly takes place by equipping the front segment 74 with two lateral anchoring members 76, inserted by interlocking inside hollow ends of the lateral segments 72.

With the same function previously described, the element 50 is mounted on the internal wall of the front segment 74, e.g. in correspondence of one of the two anchoring members 76.

The setting of the element 50 is a fast and inexpensive solution to constrain the guide 20 to a sliding drawer or shelf. Because the element 50 is removable or applicable independently of the rest, another advantage is being able to retrofit with an anti-lifting system a pre-existing drawer or shelf, by adding the element 50. Or one can quickly release the drawer or shelf from the guide 20 only by removing the element 50, without acting on the horizontal adjustment of the arm 26.

The element opposing the lifting of the drawer or shelf can also be built in different ways, e.g.

a block having an inclined plane (see FIG. 7) or a concavity with which to obstruct the tooth 28; and/or a block having a hole or a groove in which to insert the tooth 28; and/or a ring in which to insert the tooth 28; and/or an arch mounted cantilevered on the internal wall of the drawer or shelf;

a surface cavity, made in the body of the drawer or shelf, which is facing the tooth 28 and which can be engaged by it.

The invention claimed is:

1. Sliding drawer or shelf of a piece of furniture, comprising:

a perimeter frame defined by the union of a front segment and three C-connected segments;

a telescopic guide for linearly moving the drawer or shelf with respect to the piece of furniture, the guide comprising a part that can be fixed on the piece of furniture, and a part longitudinally translatable with respect to the fixed part, the translatable part comprising an arm which is adapted to support the drawer or shelf and on which there is mounted an adjustment element for the inclination of the drawer or shelf with respect to the fixed part, wherein the front segment comprises a stop element by which a free end of the arm can be engaged, said free end comprising a protruding tooth adapted to be inserted into the stop element and arranged along a longitudinal axis of the arm so that said tooth opposes to a lifting of the drawer or shelf by abutting against a wall of the stop element;

wherein the stop element comprises or forms a cavity inside which said tooth is trappable; and wherein the stop element comprises a step and is mounted on the front segment so that the cavity is formed by a surface of the step and a wall of the front segment.

2. Sliding drawer or shelf according to claim 1, wherein the stop element is superficially mounted on the front segment to form said cavity.

3. Sliding drawer or shelf according to claim 2, wherein the stop element is a solid with an L-shaped cross-section.

4. Sliding drawer or shelf according to claim 1, wherein the adjustment element is rotatably mounted in the arm to protrude from the arm and to abut on the drawer or shelf by means of an adjustable-projection portion.

5. Sliding drawer or shelf according to claim 4, wherein the rotatably mounted element is provided with a thread and is screwed into the arm to protrude from the arm by means of said adjustable-protruding portion.

6. Sliding drawer or shelf according to claim 1, wherein the front segment and the three C- connected segments are hollow tubular elements, each with ends cut at 45 degrees to fit with ends of the other two of said segments.

7. Sliding drawer or shelf according to claim 1, wherein the stop element is a block integrally mounted inside the front segment, on the surface facing the inside of the sliding drawer or shelf, the block being a parallelepiped lacking an edge and comprising a step defined by the union of two parallelepipeds having different bases and two coplanar sides, the block being mounted on the front segment so that its step forms said cavity in the internal wall of the front segment.

8. Sliding drawer or shelf according to claim 7, wherein said block is integrally mounted with screws or adhesive.

9. Sliding drawer or shelf according to claim 1, wherein the stop element is a block having an inclined plane with which to obstruct said tooth.

10. Sliding drawer or shelf according to claim 1, wherein the stop element is a block and the cavity is a concavity with which to obstruct said tooth.

11. Sliding drawer or shelf according to claim 1, wherein the stop element is a block and the cavity is a hole or a groove in which to insert said tooth.

12. Sliding drawer or shelf according to claim 1, wherein the three C-connected segments are hollow tubular elements, each with ends cut at 45 degrees to fit ends of the other two segments, and the front segment comprises a rigid wall provided with two anchoring members that protrude orthogonally therefrom and are each insertable in a respective cavity of a different segment forming the C.

* * * * *